US010703553B2

(12) United States Patent
Haas

(10) Patent No.: US 10,703,553 B2
(45) **Date of Patent: *Jul. 7, 2020**

(54) RETAINING MEMBER AND INSULATING VESSEL INCORPORATING SAME

(71) Applicant: Vinglacé, LLC, Houston, TX (US)

(72) Inventor: Colton Bryan Haas, Houston, TX (US)

(73) Assignee: Vinglacé, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/562,474

(22) Filed: Sep. 6, 2019

(65) Prior Publication Data

US 2019/0389645 A1 Dec. 26, 2019

Related U.S. Application Data

(63) Continuation of application No. 16/334,793, filed as application No. PCT/US2017/053642 on Sep. 27,
(Continued)

(51) Int. Cl.
*B65D 81/38* (2006.01)
*A47G 23/02* (2006.01)
(Continued)

(52) U.S. Cl.
CPC ..... *B65D 81/3881* (2013.01); *A47G 23/0241* (2013.01); *B65D 23/0885* (2013.01);
(Continued)

(58) Field of Classification Search
CPC ..... B65D 81/3881; B65D 81/3876; B65D 23/0885; B65D 81/38; B65D 23/06; B65D 23/065; B65D 47/40
See application file for complete search history.

(56) References Cited

U.S. PATENT DOCUMENTS 1,999,670 A 4/1935 Strouse et al.
2,419,291 A * 4/1947 Senter, Jr. ..... A47J 41/0011 215/12.1
(Continued)

FOREIGN PATENT DOCUMENTS

DE 573055 C 3/1933
WO 2008078860 A1 7/2008
WO 2015191566 A1 12/2015

OTHER PUBLICATIONS

Bottlekeeper, Bottlekeeper (R), Apr. 25, 2013, https://www.bottlekeeper.com/, 6 pgs.
(Continued)

*Primary Examiner* — Fenn C Mathew
*Assistant Examiner* — Jennifer Castriotta
(74) *Attorney, Agent, or Firm* — Moyles IP, LLC

(57) ABSTRACT

A retaining member for use with a vacuum-insulated vessel is described. The retaining member includes a frustoconical body, a cylindrical skirt extending from the frustoconical body, and a deformable member extending along an inner surface of the frustoconical body. The deformable member may have multiple layers. An opening extends through the frustonical body, so that the neck of a bottle may pass through the opening. The vacuum-insulated vessel, in combination with the retaining member, may receive and secure bottles having different heights and widths. The retaining member and vacuum-insulated vessel also eliminates condensation from external surfaces of a bottle positioned therein, maintains the initial temperature of the bottle, and allows a user to pour from the bottle without having to remove the bottle from the vessel.

20 Claims, 16 Drawing Sheets

Related U.S. Application Data

2017, which is a continuation of application No. 15/699,462, filed on Sep. 8, 2017, now Pat. No. 9,988,202.

(60) Provisional application No. 62/508,151, filed on May 18, 2017, provisional application No. 62/400,736, filed on Sep. 28, 2016.

(51) Int. Cl.

| | |
|---|---|
| ***B65D 23/08*** | (2006.01) |
| ***B65D 25/10*** | (2006.01) |
| ***B65D 25/54*** | (2006.01) |
| ***F25D 3/08*** | (2006.01) |
| ***B65D 23/06*** | (2006.01) |
| *B65D 47/40* | (2006.01) |

(52) U.S. Cl.

CPC ..... *B65D 25/10* (2013.01); *B65D 25/54* (2013.01); *B65D 81/38* (2013.01); *B65D 81/3876* (2013.01); *A47G 2023/0275* (2013.01); *B65D 23/06* (2013.01); *B65D 47/40* (2013.01); *F25D 3/08* (2013.01); *F25D 2331/803* (2013.01)

(56) References Cited

U.S. PATENT DOCUMENTS

| | | | | |
|---|---|---|---|---|
| 2,599,767 | A | 6/1952 | Long | |
| 3,755,030 | A | 8/1973 | Doman et al. | |
| 4,299,100 | A | 11/1981 | Crisman et al. | |
| 4,815,287 | A | 3/1989 | O'Daniel | |
| 4,823,974 | A | 4/1989 | Crosser | |
| 4,870,837 | A | 10/1989 | Weins | |
| 5,904,267 | A | 5/1999 | Thompson | |
| 5,921,431 | A | 7/1999 | Pych | |
| 6,155,452 | A | 12/2000 | Laurent | |
| 6,516,967 | B2 | 2/2003 | Duff et al. | |
| 7,201,285 | B2 | 4/2007 | Beggins | |
| D765,471 | S | 9/2016 | Gorbold | |
| 2003/0197020 | A1* | 10/2003 | Murakami | B65D 81/3876 220/739 |
| 2008/0135554 | A1 | 6/2008 | Hill et al. | |
| 2012/0292219 | A1 | 11/2012 | Terwilliger et al. | |
| 2017/0137207 | A1 | 5/2017 | Mackintosh et al. | |
| 2017/0166385 | A1 | 6/2017 | Pisarevsky | |
| 2018/0043731 | A1 | 2/2018 | Cheng | |

OTHER PUBLICATIONS

International Searching Authority, International Search Report and Written Opinion of International App. No. PCT/US17/53642, dated Nov. 27, 2017, which is in the same family as U.S. Appl. No. 15/699,462, 11 pgs.

International Searching Authority, International Preliminary Report on Patentability of International Application No. PCT/US2017/053642 dated Apr. 2, 2019, 7 pgs.

European Patent Office, Examination Report of International Application No. 17781598.2, which is in the same family as U.S. Appl. No. 16/562,474, dated Feb. 11, 2020, 2 pgs.

* cited by examiner

FIG. 3
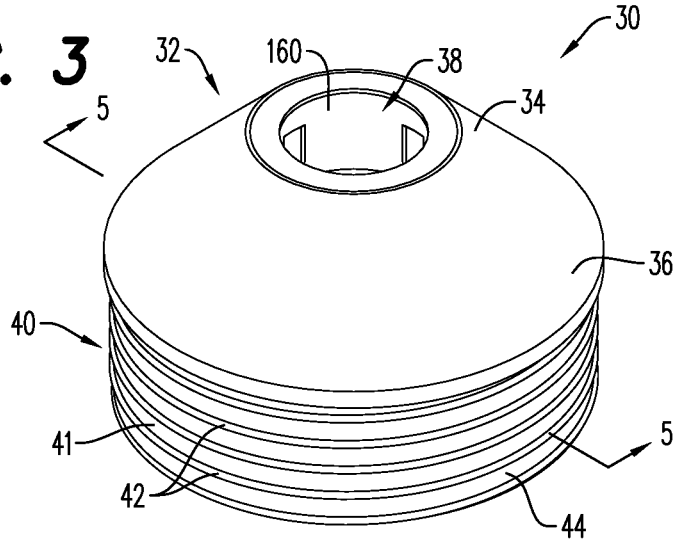
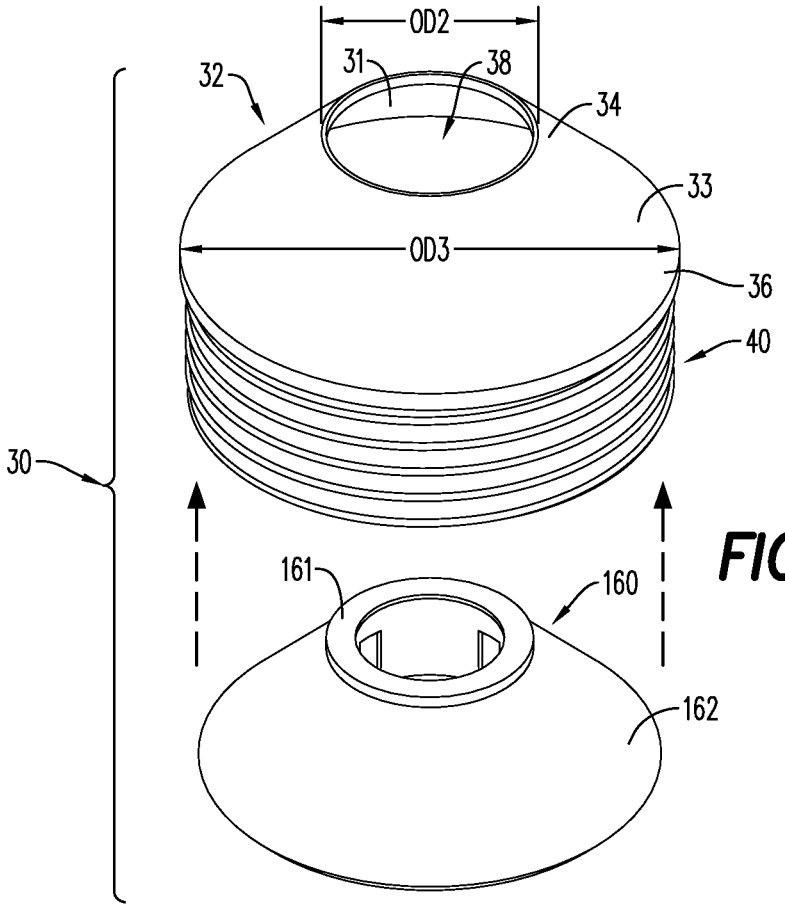
FIG. 4

RETAINING MEMBER AND INSULATING VESSEL INCORPORATING SAME

CROSS-REFERENCE TO RELATED APPLICATIONS

This application is a continuation of U.S. Non-Provisional application Ser. No. 16/334,793 filed Mar. 20, 2019, which claims priority to PCT Application No. PCT/US2017/053642 filed Sep. 27, 2017, which claims priority to U.S. Non-Provisional application Ser. No. 15/699,462 filed Sep. 8, 2017 now U.S. Pat. No. 9,988,202 issued Jun. 5, 2018, which claims the benefit of U.S. Provisional Application No. 62/508,151 filed May 18, 2017 and U.S. Provisional Application No. 62/400,736 filed Sep. 28, 2016, each which is incorporated herein by reference in its entirety.

FIELD

A retaining member for use with an insulated vessel is generally described. More specifically, an insulated container having a retaining member that holds bottles of different shapes and sizes, while also maintaining the temperature of bottle and eliminating condensation thereon, is described.

BACKGROUND

Maintaining the temperature of bottled beverages, such as wine and champagne, is vital to enjoying the complete characteristics each beverage has to offer. Various types of coolers are used to chill or impart cooler temperatures to such bottled beverages. For instance, ice is often placed in such coolers and the bottled beverages are placed in the coolers, such that that they are in contact with the ice and become cooler based on the contact. A disadvantage with such coolers is that once the ice melts, the remaining water may become warm and unable to maintain a colder temperature for the bottled beverage. Another disadvantage is that once the bottled beverage is removed from the cooler, large amounts of liquid may remain on the external surface of the bottled beverages, which may make the bottles slippery and cause the bottles to fall out of the user's hands. This may be dangerous to the user and others nearby, particular when the bottles are made of glass.

Other variations of coolers may be in the form of individual bottle holders within which the bottle beverages are positioned. Such bottle holders may include inner and outer shells, and an insulating material arranged between the inner and outer shells. Such insulating material may include, for instance, refrigerant/coolant, gel, and other types of freezable liquid. In order to secure the inner and outer shells together and prevent leakage of the liquid, gaskets or rubber materials are used. The inner shell may include several rubberized materials or spacers joined to the inner surface of the bottle holder to secure the bottle in place and adjust to bottles that have different diameters. In addition, the inner surfaces may include a stepped portion to receive bottles that are wider and shorter, or bottles that are narrower. The bottle holders may include a cap or stopper for covering the bottle holder. When a bottled beverage is housed in the bottle holders, the bottled beverage may be completely enclosed within the bottle holder, requiring the user to remove the cap/lid, and in some instances, the bottled beverage in order to retrieve the beverage (or pour from the bottle), which may be cumbersome. These typical bottle holders include numerous components, and numerous shapes, which may be expensive and difficult to manufacture and assemble.

In view of the disadvantages associated with presently available bottle holders, there is a need for an insulating vessel that houses bottled beverages within the vessel, and is able to maintain the temperature of bottles that are warm and the temperature of bottles that are cold. There is a further need for a vessel that is able to accommodate bottles of different shapes and sizes, while also allowing users to pick up the vessel and pour the contents of the bottle without having to remove the bottle from the vessel. Additionally, there is a need for an insulating vessel that prevents the formation of condensation on the surface of a bottled beverage housed therein.

BRIEF DESCRIPTION

The present embodiments may be associated with a retaining member that may be used with a vessel/container. The retaining member may include a frustoconical body and a cylindrical skirt that extends from the frustoconical body. The frustoconical body includes an upper portion, a lower portion, and an opening that extends between the upper and lower portions. This opening is configured to allow the neck of a bottle to extend therethrough. The frustoconical body includes an inner surface and an outer surface. A deformable member may extend between the upper and lower portions of the frustoconical body. According to an aspect, the deformable member has multiple layers, with at least one layer extending along the inner surface of the retaining member. In an embodiment, the cylindrical skirt extends from the lower portion of the frustoconical body. The cylindrical skirt may include a plurality of external threads formed on its external surface. According to an aspect, the external threads may be made according to any thread patterns, so that they are able to engage with internal threads formed on a container.

According to an aspect, the present embodiments may also be associated with a vacuum-insulated vessel/container that receives a retaining member made substantially as described hereinabove. The vacuum-insulated vessel includes a double-walled structure. The double-walled structure includes an open end and a closed end, and a cylindrical body extends between the open and closed ends. The cylindrical skirt may frictionally engage with an internal surface of the double-walled structure. In an embodiment, a plurality of internal threads is formed on an internal surface of the cylindrical body, adjacent the open end. The retaining member may be rotatably received on (e.g., screwed onto/into) the open end of the double-walled insulated vessel, by engaging the external threads of the skirted portion of the retaining member with the internal threads of the cylindrical body. The vacuum-insulated vessel may receive and secure bottles having different heights and widths, while also eliminating condensation on external surfaces of the bottles and maintaining the initial temperatures of the bottles. In an embodiment, a deformable member is provided. At least one layer of the deformable member may be compressed against bottles positioned in the vacuum-insulated vessel, helping to secure the bottles in place.

Further embodiments of the disclosure relate to a vacuum-insulated vessel including a double-walled structure having an inner container and an outer container spaced apart from one another so that a gap is formed between them. Similar to the double-walled structure described hereinabove, the inner and outer containers each include a closed end, an open end, and a substantially cylindrical body that extends between their closed and open ends. In an embodiment, the gap between the inner and outer containers is evacuated of air, and each container is coupled to the other and sealed at each of their respective open ends. The vacuum-insulated vessel further includes the retaining member and the deformable member, which may be configured as described hereinabove.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which:

FIG. 3 is a perspective view of a retaining member, according to an embodiment;

FIG. 4 is an exploded view of the retaining member of FIG. 3;

Figure 1:
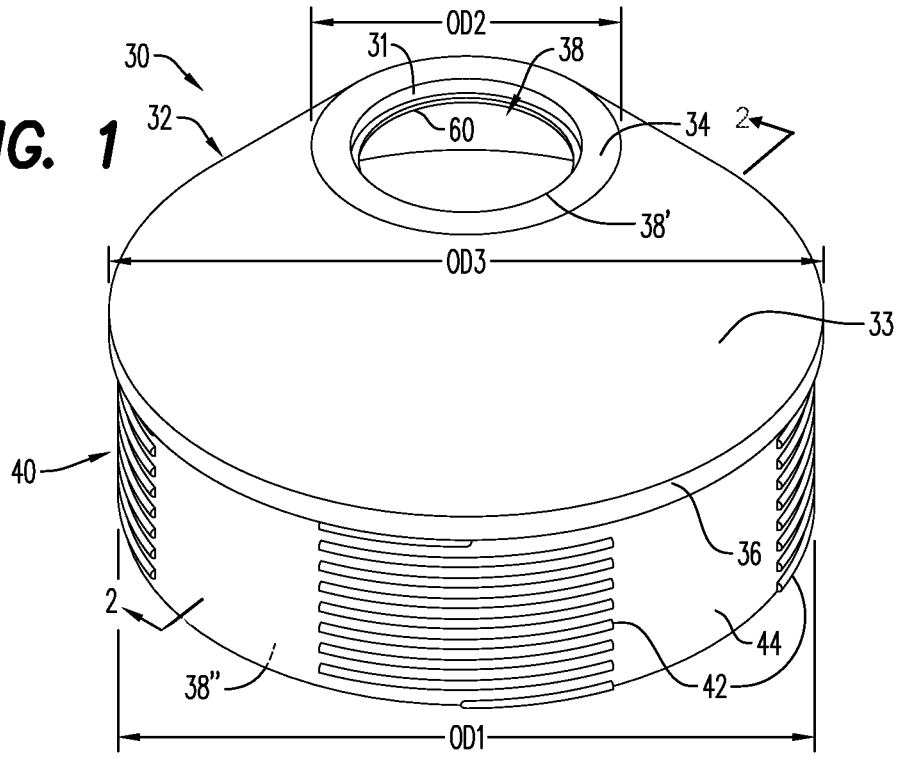
FIG. 1 is a perspective view of a retaining member, according to an embodiment.
Figure 2:
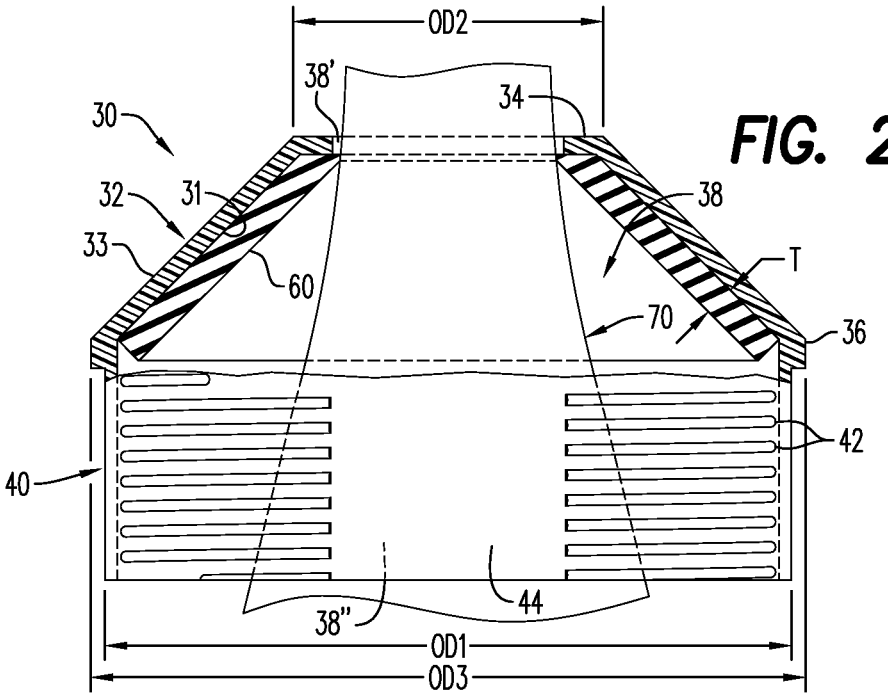
FIG. 2 is a cross-sectional view of the retaining member of FIG. 1, illustrating a bottle secured therein with the retaining member in engagement with a neck of the bottle.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

According to an aspect, a vacuum-insulated vessel having a retaining member and a double-walled structure/insulated container is described. The vacuum-insulated vessel maintains the temperature of a bottle/bottled beverage housed therein, whether the initial temperature of the bottle is hot, warm or cold. The vacuum-insulated vessel also eliminates the formation of condensation on the external surface of the bottle. The vacuum-insulated vessel is able to receive and retain bottles of various sizes and/or shapes, while also allowing the user to pour the contents of the bottles without having to remove the bottles from the vessel. The vacuum-insulated vessel may be particularly useful for alcoholic beverages (or other chilled beverages), such as white or red wine, champagne, beer, and the like, which are often best enjoyed at specific temperature ranges, and come in various shapes and sizes.

A retaining member is also generally described herein. The retaining member includes a frustoconical body having an upper portion and a lower portion, and a cylindrical skirt extending from the lower portion. As used herein, the term "frustoconical" may mean that the body has the general shape of a cone with a fractured tip (or open tip) forming an upper edge that is parallel to a lower edge of the cone. The lower portion of the frustoconical body is larger than the upper portion of the frustoconical body. The cylindrical skirt includes a plurality of external threads formed on its external surface. The threads may be one of continuous threads or interrupted threads. As used herein, "continuous threads" may mean a non-interrupted threaded closure having a spiral design (e.g., extending around the skirt like a helix), while "interrupted threads" may mean a non-continuous/segmented threaded pattern having gaps/discontinuities between each adjacent thread. In an embodiment, the retaining member includes a deformable member extending along an inner surface of the frustoconical body. The retaining member is configured for use with an insulated vessel/container for housing bottles of different shapes and sizes.

For purposes of illustrating features of the embodiments, examples will now be introduced and referenced throughout the disclosure. Those skilled in the art will recognize that these examples are illustrative and not limiting, and are provided purely for explanatory purposes.

Turning now to the figures, FIGS. 1-6 illustrate an exemplary retaining member 30. The retaining member 30 includes a generally frustoconical body 32 and a cylindrical skirt 40. The body 32 and skirt 40 may be formed integrally with one another (e.g., as a single or unitary part or component), or may be formed separately from one another and joined to one another. In an embodiment, the frustoconical body 32 and the cylindrical skirt 40 each comprise a substantially clear plastic material. The plastic materials utilized may include materials that are free from potentially health hazardous materials such as, bisphenol A (BPA), bisphenol S (BPS), and the like. According to an aspect, the frustoconical body 32 and the cylindrical skirt 40 are formed from polymers or polymeric materials, such as polyethylene terephthalate, polycarbonate (e.g., Tritan™), acrylic, and the like, or any combination thereof. The frustoconical body 32 and the cylindrical skirt 40 may be formed from a material suitable for food and/or drink contact. In some embodiments, the retaining member 30 is vacuum-insulated, by virtue of being formed with double walls and having air evacuated from the spaces between the double walls. This helps to eliminate conduction and/or convection across the surfaces of the retaining member 30.

The frustoconical body 32 has an upper portion 34 (i.e., a first end), and a lower portion 36 (i.e., a second end). In an embodiment, an opening/aperture 38 (i.e., a void space) extends between the upper and lower portions 34, 36, so that the frustoconical body 32 is a hollow frustoconical body 32 having a pair of open ends 38', 38" opposite one another. The lower portion 36 has an outer diameter $OD_3$, which is larger than a respective outer diameter $OD_2$ of the upper portion 34. The outer diameters $OD_2$, $OD_3$ of the lower and upper portions 36, 34 may be sized to increase or decrease an outward taper of the frustoconical body 32 from the upper portion 34 to the lower portion 36, which may help facilitate the ability for the frustoconical body 32 to be received by the necks and/or shoulders of bottles 70 having different sizes and shapes.

The frustoconical body 32 has an inner surface 31 and an outer surface 33. As seen for instance in FIG. 2, a deformable member 60 (e.g., a gasket or seal) may be positioned along the inner surface 31. The deformable member 60 may extend around the inner surface 31 along the upper portion 34 of the frustoconical body 32. In an embodiment, the deformable member 60 may be a single layer of material that extends from the upper portion 34 to the lower portion 36 of the frustoconical body 32, so that it is adjacent to and extends along the entire inner surface 31 of the frustoconical body 32. The deformable member 60 may be formed from any material that may be repeatably compressed and/or is able to maintain compression for an extended period of time. Such materials include rubber, plastic, foam, and the like. The deformable member may be formed from an opaque material. According to an aspect, the deformable member is a material having a uniform consistent thickness along its length.

Figure 5:
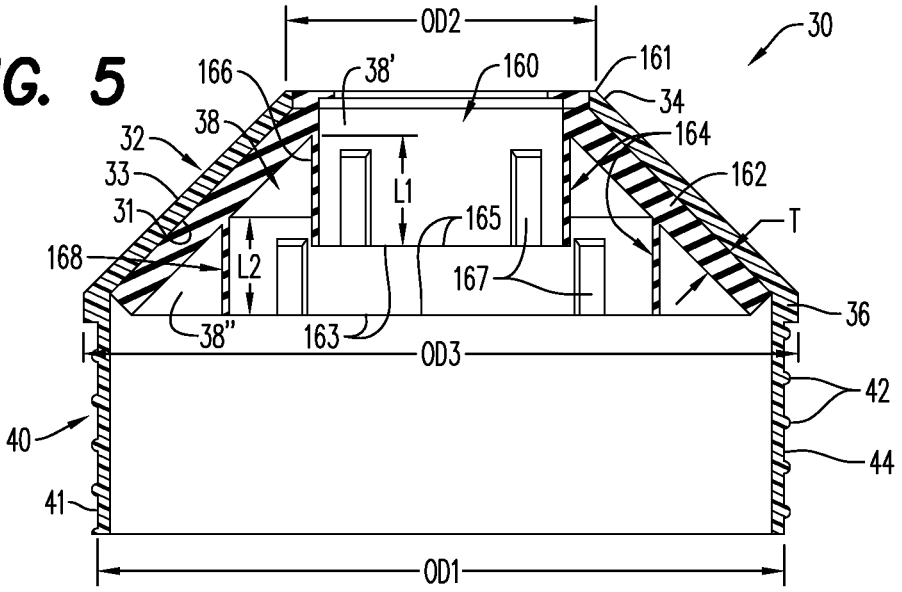
FIG. 5 is a cross-sectional view of the retaining member of FIG. 3.
Figure 6:
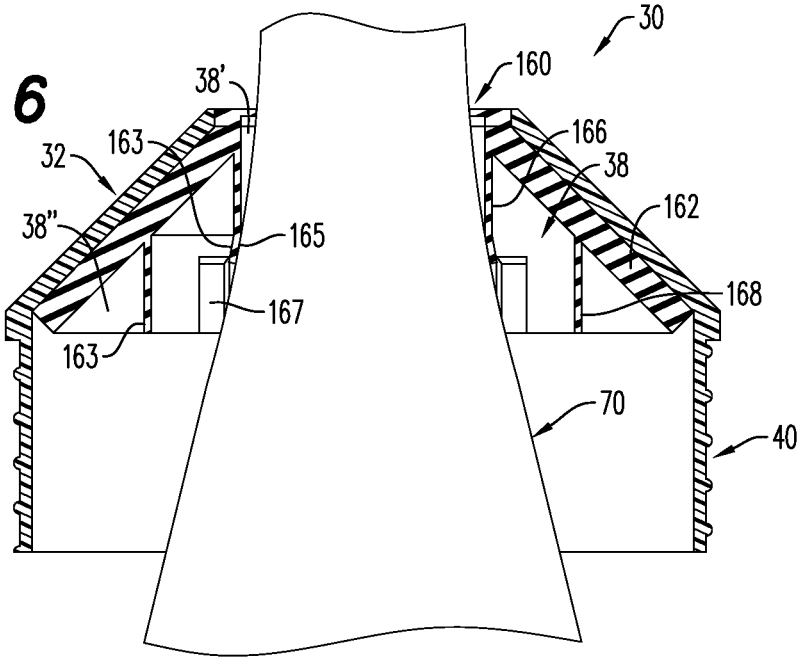
FIG. 6 is a cross-sectional view of the retaining member of FIG. 3, illustrating a bottle secured therein with the retaining member in engagement with a neck of the bottle.

FIGS. 3-6 illustrate a further embodiment of a deformable member (a multilayered deformable member) 160. As illustrated in FIG. 3, the multilayered deformable member 160 is disposed within the opening 38 of the frustoconical body 32, with at least a portion of the multilayered deformable member 160 extending along the inner surface 32 of the frustoconical body 32. FIGS. 4-6 illustrate the multilayered deformable member 160 having a circumferential edge portion 161. The circumferential edge portion 161 may be sized to fit snugly within the opening 38 of the frustoconical body 32 at its upper portion 34. According to an aspect, the circumferential edge portion 161 may be secured to the frustoconical body 32 by any fastening mechanism, as would be understood by one of ordinary skill in the art. For example, the circumferential edge portion 161 may include a groove that extends around its external surface and the upper portion 34 of the frustoconical body 32 may include a protrusion that engages with the groove, thus retaining the multilayered deformable member 160 in place.

As seen for instance, in the exemplary embodiment illustrated in FIG. 4, the multilayered deformable member 160 includes a first layer 162 that extends away from the circumferential edge portion 161. The first layer 162 extends along the inner surface 31 of the frustoconical body 32, and has the same general shape of the frustoconical body 32. According to an aspect, the first layer 162 is attached to, adhered to or otherwise connected to the inner surface 31. As described hereinabove with respect to the circumferential edge portion 161, the first layer 162 may be secured to the inner surface 31 by any securing/fastening mechanism. Such mechanisms include, but are not limited to glues, fasteners, and the like. As illustrated in FIGS. 5-6, the multilayered deformable member 160 includes a plurality of concentric layers 164 positioned inwardly from the first layer 162. The first layer and each of the additional concentric layers are arranged in a spaced apart configuration with respect to each other. The concentric layers 164 downwardly extend from either the circumferential edge portion 161 or from the first layer 162. Each concentric layer 164 has a resilient free end 163 having a peripheral edge 165. A plurality of longitudinally opening notches 167 is formed in the peripheral edges 165 of the concentric layers 164, which help to provide added flexibility and movement to the concentric layers 164. The longitudinally opening notches 167 may be of any length, and may extend over a majority of the surface of the concentric layer 164 in which they are formed. According to an aspect, the notches 167 extend at a distance of up to about 75% the length of the concentric layer 164. Alternatively, the notches 167 extend at a distance of up to about 50% the length of the concentric layer 164. The notches 167 may be formed by removal of material from portions of the peripheral edges 165 of the concentric layers 164, and may have any general shape, such as tubular, rectangular, and the like.

As illustrated in FIG. 6, the concentric layers 164 may include a first concentric layer 166 and a second concentric layer 168. The first concentric layer 166 is laterally and longitudinally spaced apart from the second concentric layer 168. According to an aspect, the first concentric layer 166 downwardly extends from the circumferential edge portion 161, while the second concentric layer 168 downwardly extends from an intermediate position of the first layer 162 (i.e., a position between the upper and lower portions 34, 36 of the frustoconical body 32). The first concentric layer 166 is inwardly positioned from the first layer 162, and the second concentric layer 168 is circumferentially positioned around the first concentric layer 166, such that it is positioned generally between the first concentric layer 166 and the first layer 162. Each of the first and second concentric layers 166, 168 have a respective length L1, L2 (see, for example, FIG. 5), which may be sized so that they do not extend beyond the lower portion 36 of the frustoconical body 32. In at least one embodiment, the respective lengths L1, L2 of the first and second concentric layers 166, 168 are the same, so that their peripheral edge portions are vertically spaced apart from each other. Alternatively, the respective lengths L1, L2 of the first and second concentric layers 166, 168 are different from each other. For example, the length L1 of the first concentric layer 166 may be greater than the length L2 of the second concentric layer 168, and their peripheral edges 165 are equidistantly spaced apart from the skirt 40 of the retaining member 30.

The cylindrical skirt 40 of the retaining member 30 extends from the lower portion 36 of the frustoconical body 32. According to an aspect, the cylindrical skirt 40 is integrally formed with the frustoconical body 32. In other words, the cylindrical skirt 40 may extend from the frustoconical body 32, such that it is adjacent or connected to the lower portion 36. The cylindrical skirt 40 may frictionally engage with an internal surface of an insulated container 20. Alternatively, the cylindrical skirt 40 includes a plurality of external threads 42 formed on its external surface 44. The external threads 42 may be interrupted/non-continuous threads (see, for example, in FIGS. 1-2) or continuous/spiral threads (see, for example, FIGS. 3-4). In an embodiment, the external threads 42 are configured to mate/engage with corresponding internal threads 28 formed on an internal surface 29 of an insulated container 20 (see, for example, FIG. 7). The cylindrical skirt 40 includes an outer diameter $OD_1$ that is slightly less that an inner diameter ID of the insulated container 20, so that the external threads 42 and the internal threads 28 engage with each other to adjustably secure the retaining member 30 to the insulated container 20. The external threads 42 help to provide sealing and resealing of the insulated container 20.

Embodiments of the disclosure are further directed to a vacuum-insulated vessel 10. As shown in FIGS. 7-12 and, the vacuum-insulated vessel 10 includes a double-walled structure 20. The double-walled structure 20 is vacuum-insulated so that interstitial spaces between each wall of the double-walled structure 20 are devoid of air. This provides a significant reduction of the transference of heat by conduction or convection, and increases the length of time that the temperature of the contents of a bottle placed in the vacuum-insulated vessel 10 may remain hot, warm or cold. The double-walled structure 20 may include plastic and/or metallic materials suitable for food and/or water contact. According to an aspect, the double-walled structure 20 may be formed from a metal, such as, stainless steel.

Figure 7:
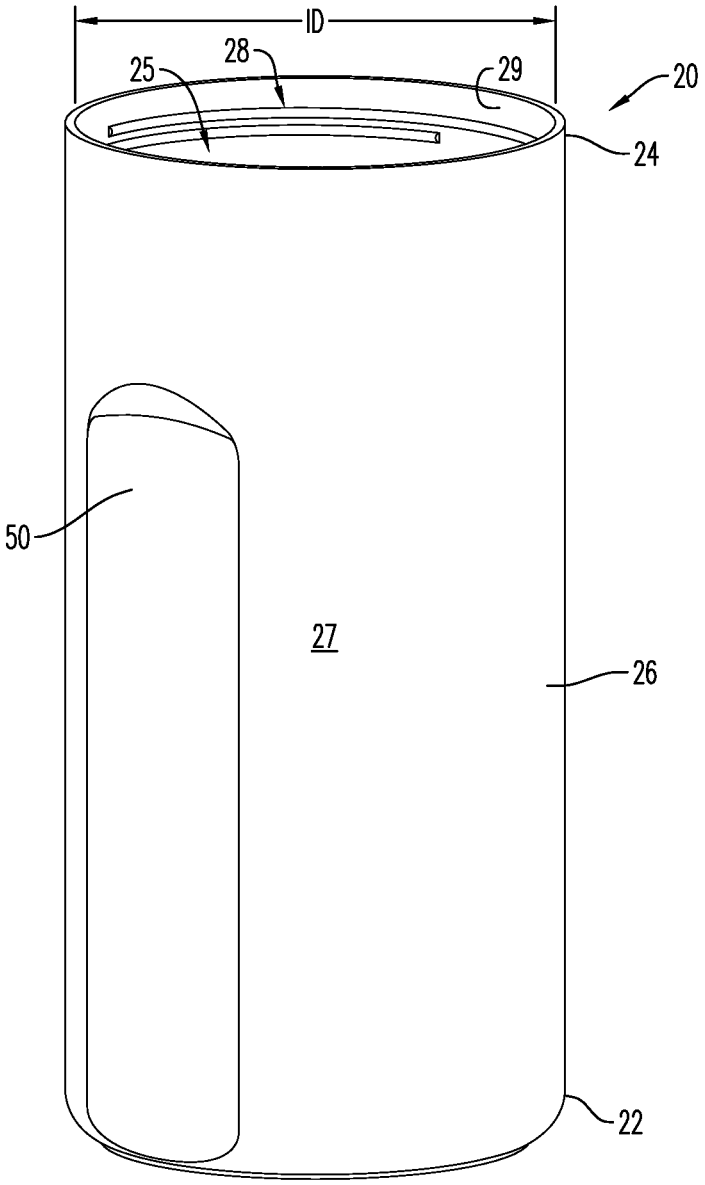
FIG. 7 is a perspective view of a double-walled container of a vacuum-insulated vessel, according to an embodiment.

According to an aspect, and as illustrated in FIG. 7, the double-walled structure 20 includes a closed end 22, an open end 24, and a cylindrical body 26 that extends between the closed and open ends 22, 24. The open end 24 is configured to receive bottles 70 (see, for example, FIG. 10) within an internal space 25 of the double-walled structure 20, while the closed end 22 provides a surface for seating the bottle 70 thereon within the internal space 25. The double-walled structure 20 may include a plurality of indentations 50 formed in its external surface 27. In an embodiment, the indentations 50 extend from the closed end 22 of the double-walled structure 20 to an intermediate position between the closed end 22 and the open end 24. The indentations 50 may be flattened areas/depressions formed in the cylindrical body 26. In an embodiment, the indentations 50 are configured as rectangle-shaped flattened areas, the longer sides of the rectangle-shaped flattened areas extending from the closed end 22 towards the open end 24. The indentations 50 extend inwardly towards an internal space/chamber 25 of the double-walled structure 20 and may function as grip areas/surfaces for placement of the user's fingers to help provide a more secure/stable grip for a user of the vacuum-insulated vessel 10. The indentations 50 may also enhance the user's comfort when holding the double-walled structure 20, inserting a bottle within the internal space 25 of double-walled structure 20, rotatably securing a retaining member 30 on the open end 24 of double-walled structure 20, and pouring/dispensing liquid from a bottle 70 secured in the vacuum-insulated vessel 10. As seen, for instance, in FIGS. 8-9, the indentations 50 may span more than 50% of a length L3 of the body 26. In an embodiment, the indentations 50 are bilateral indentations 50' (i.e., a pair of indentations) (see, for example, FIG. 19), formed on opposite portions of the external surface 27. It is to be understood, however, the number of indentations 50 provided on the external surface 27 may be modified. For instance, a single indentation 50 may be formed in the double-walled structure 20. According to an aspect, 3, 4, 5, or more indentations 50 may be provided.

Figure 13:
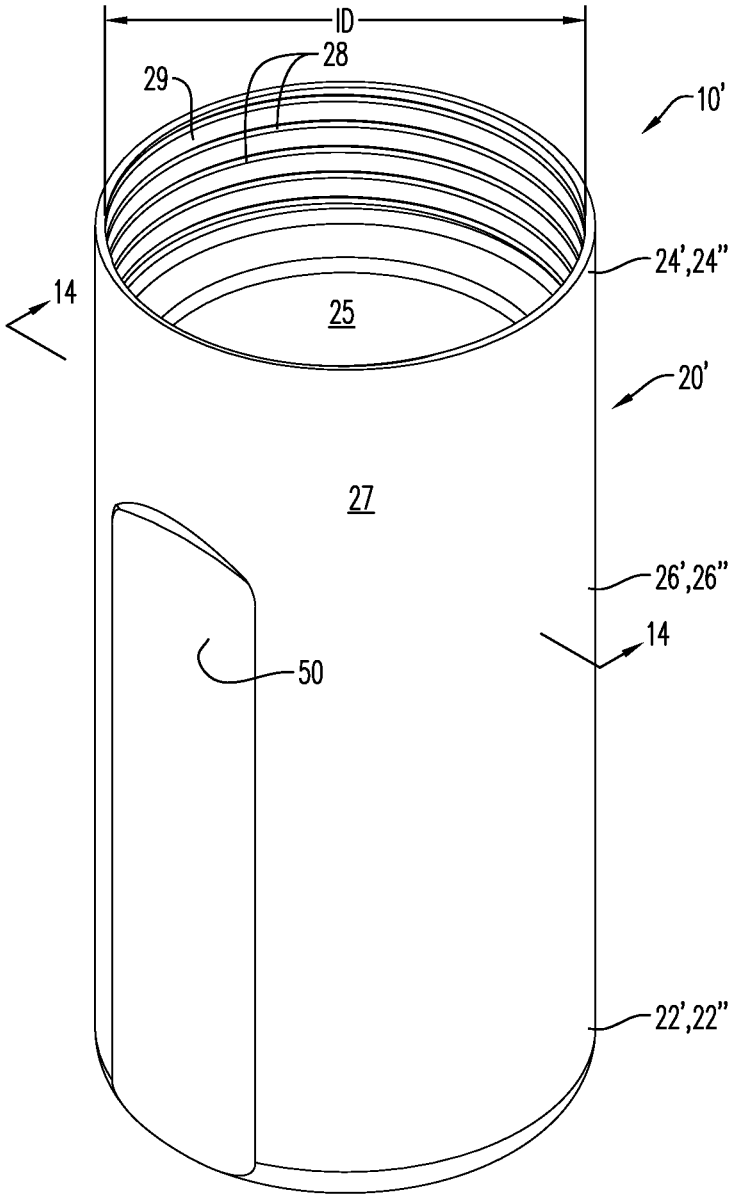
FIG. 13 is a perspective view of a double-walled container of a vacuum-insulated vessel, according to an embodiment.
Figure 14:
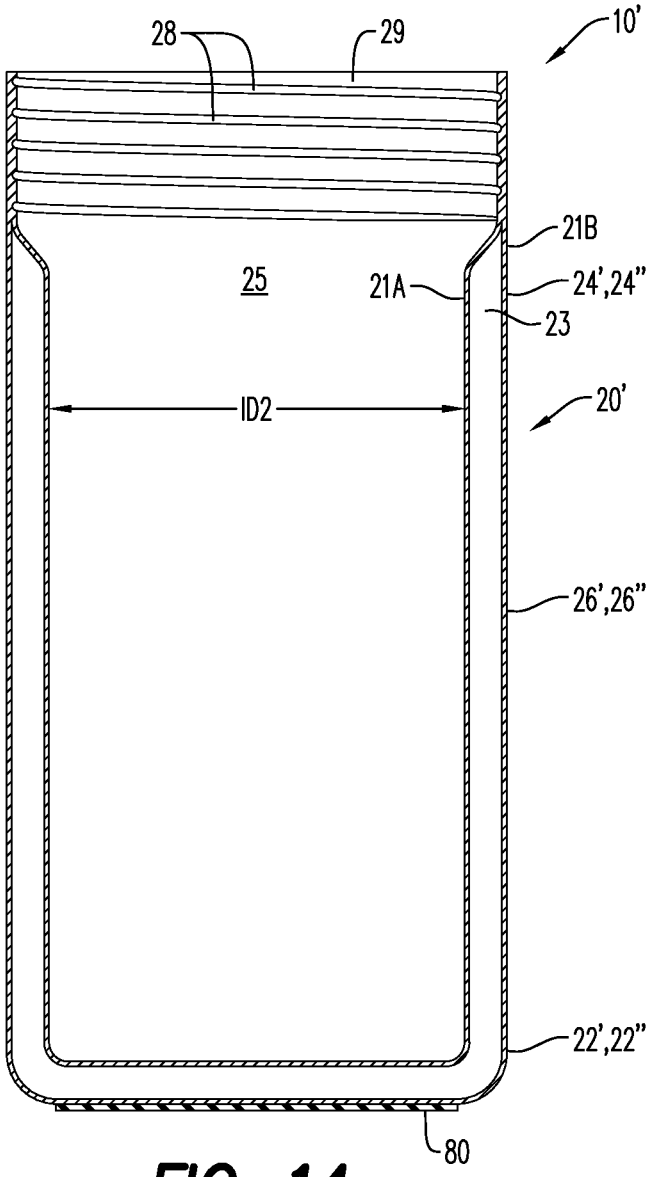
FIG. 14 is a cross-sectional view of the double-walled container of FIG. 13 illustrating an inner container and an outer container, according to an embodiment.

FIG. 7 illustrates the cylindrical body 26 having a plurality of internal threads 28 formed on its internal surface 29. While the internal threads 28 are depicted as a continuous/spiral thread pattern, it is understood that the internal threads may bean interrupted/non-continuous thread pattern as illustrated in FIG. 13). The type of thread pattern selected for the internal threads 28 may be the same as or different from the thread pattern of external threads of a corresponding retaining member with which the internal threads 28 mate (as will be described in further detail hereinbelow). In an embodiment, the internal threads 28 are adjacent the open end 24. The internal threads 28 may extend between a medial/middle portion along the length L3 of the cylindrical body 26 and the open end 24.

Figure 8:
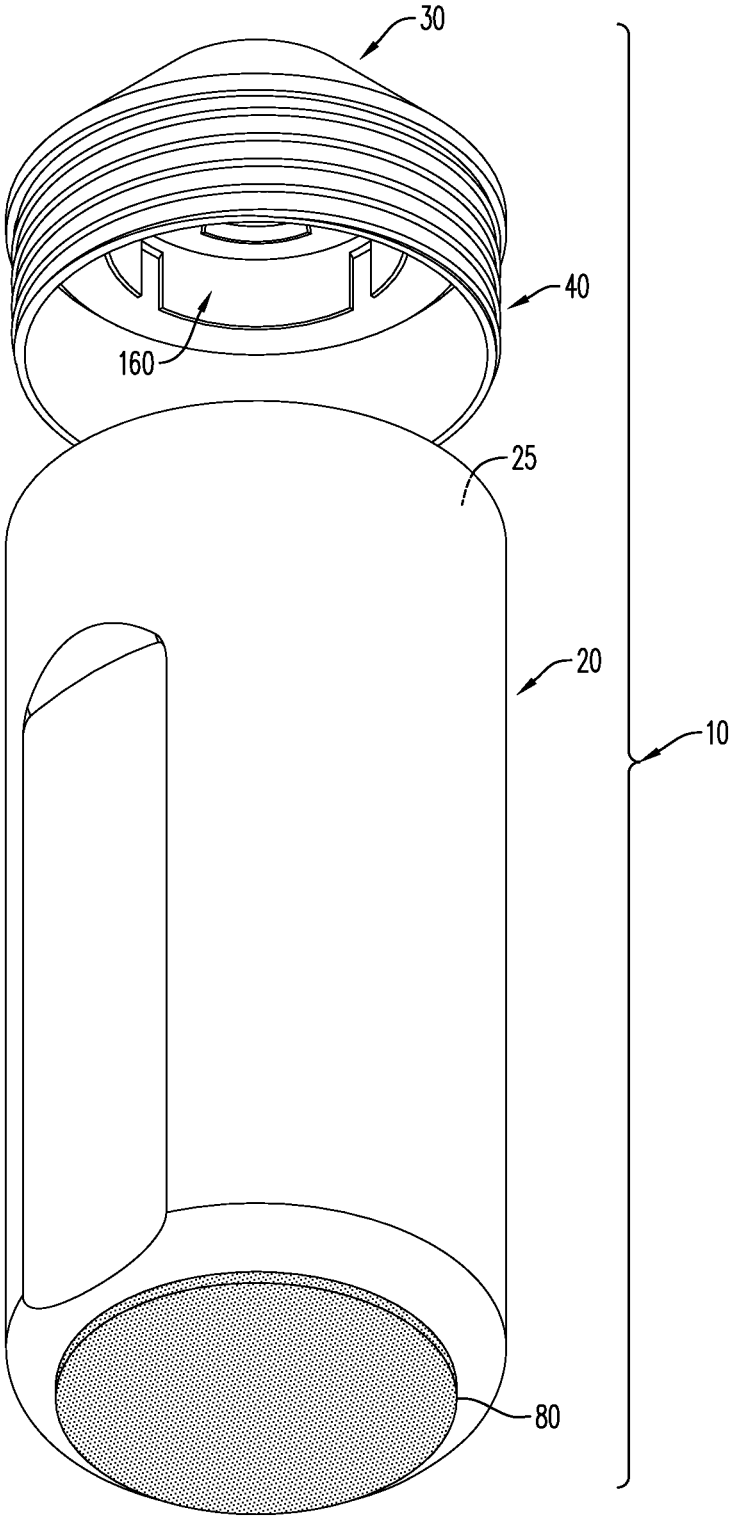
FIG. 8 is a bottom-up, partially exploded view of a vacuum-insulated vessel, according to an embodiment.
Figure 10:
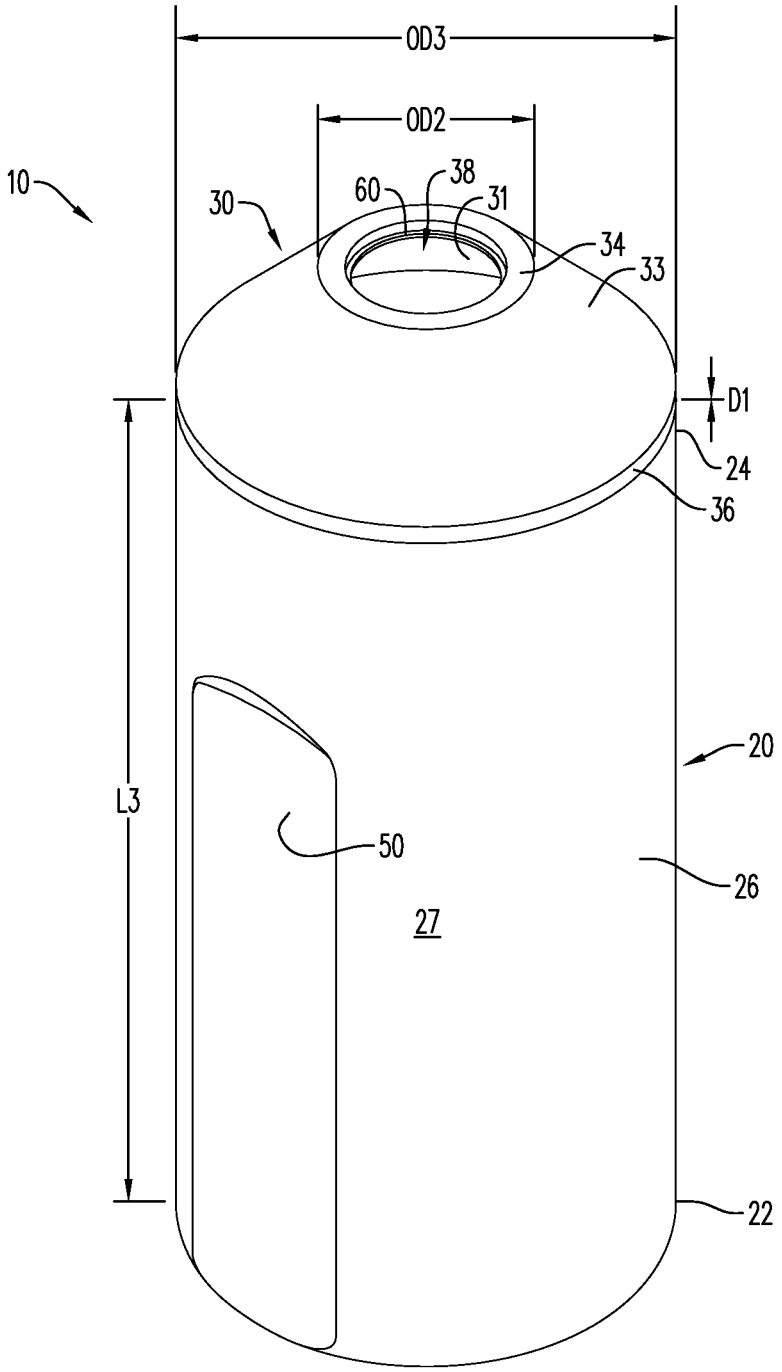
FIG. 10 is a perspective view of a vacuum insulated vessel, according to an embodiment.

FIG. 8 illustrates the vacuum-insulated vessel 10 having a retaining member 30 for being positioned in a covering relationship with (i.e., to cover) the open end 24 of the double-walled structure 20. The retaining member 30 is illustrated as having a multilayered deformable member 160, but as illustrated in FIG. 10, a single layered deformable member 60 may be included. The retaining member 30 may be secured at the open end 24 of the double-walled structure 20. The retaining member 30 and the deformable member 60/160 are similar to the retaining member 30 and the deformable member 60/160 illustrated in FIGS. 1-6 and described hereinabove. Thus, for purposes of convenience and not limitation, the various features, attributes, and properties, and functionality of the retaining member 30 and the deformable member 60/160 discussed in connection with FIGS. 1-6 are not repeated here.

Figure 9:
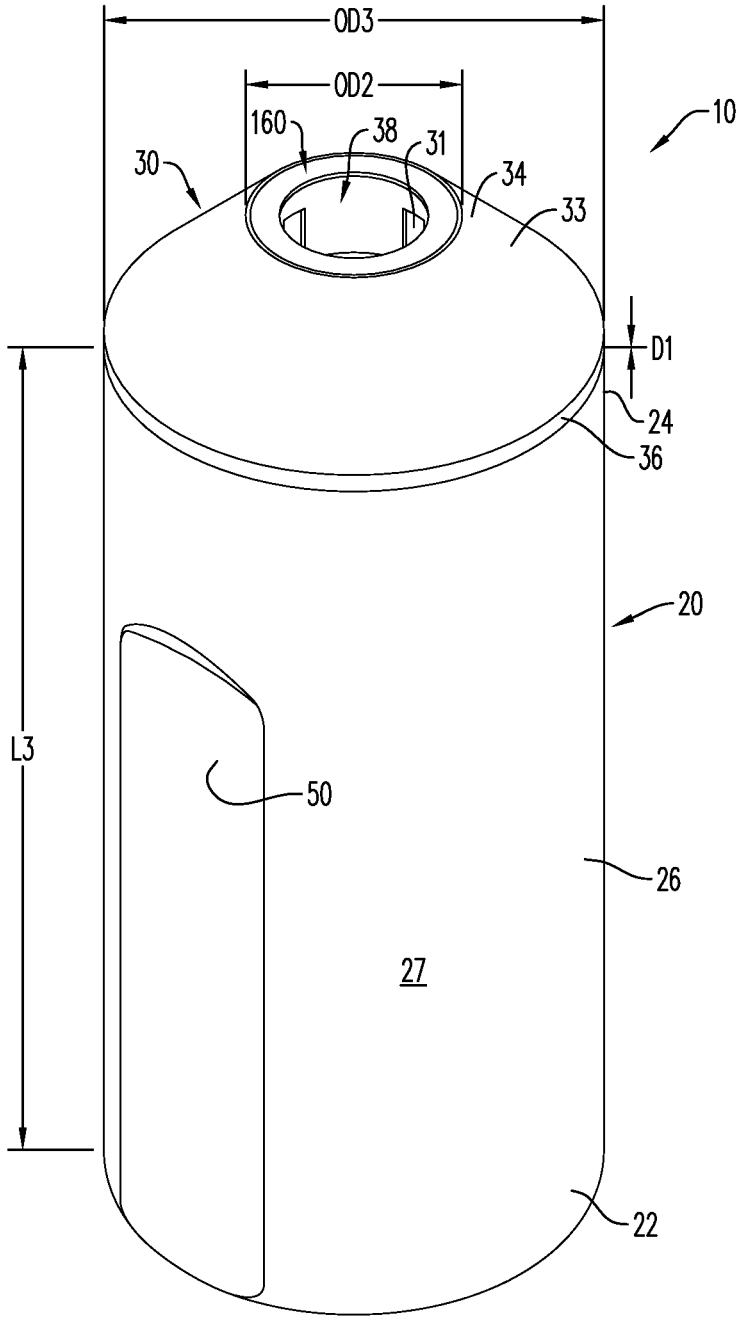
FIG. 9 is a perspective view of the vacuum-insulated vessel of FIG. 8.

As shown in FIGS. 9-10, the retaining member 30 is positioned adjacent the open end 24 of the double-walled structure 20. In this configuration, the opening 38 of the retaining member 30 communicates with the internal space 25 of the double-walled structure 20. According to an aspect, the cylindrical skirt 40 is sized so that it is receivable within the double-walled structure 20, and the frustoconical member 30 is sized so that its lower end 36 is flush with respect to the cylindrical body 26 of the double-walled structure 20. In an embodiment and as shown in FIGS. 1-5, the cylindrical skirt 40 and each of the upper and lower portions 34, 36 of the frustoconical body 32 includes an outer diameter. The outer diameter $OD_3$ of the lower portion 36 may be greater than the outer diameter $OD_2$ of the upper portion 34, while the outer diameter $OD_1$ of the cylindrical skirt 40 may be less than the outer diameter of the lower portion 36. According to an aspect, the double-walled structure 20 has an inner diameter ID that is slightly greater than the outer diameter of the cylindrical skirt 40, so that the cylindrical skirt 40 may be rotatably received within (i.e., screwed into) the chamber 25. In an embodiment, the double-walled structure 20 includes an outer diameter $OD_4$ that is substantially the same as the outer diameter $OD_3$ of the lower portion 36, so that the lower portion 36 of the frustoconical body 32 may be flush with the double-walled structure 20 when adjacent its open end 24.

According to an aspect, the external threads 42 of the cylindrical skirt 40 and the internal threads 28 of the double-walled structure 20 engage with each other so that the retaining member 30 may be rotatably secured to the double-walled structure 20. The external threads 42 may span (i.e., be formed on) the entire external surface 44 of the cylindrical skirt, so that engagement between the external threads 42 and the internal threads 28 begins with limited insertion of the cylindrical skirt 40 within the chamber 25 of the double-walled structure 20. In an embodiment, the cylindrical skirt 40 has a greater number of the external threads 42 (or rows of external threads 42) than the internal threads 28 of the double-walled structure 20. This allows the cylindrical skirt 40 to be rotatably received further within the chamber 25 of the double-walled structure 20.

Figure 11:
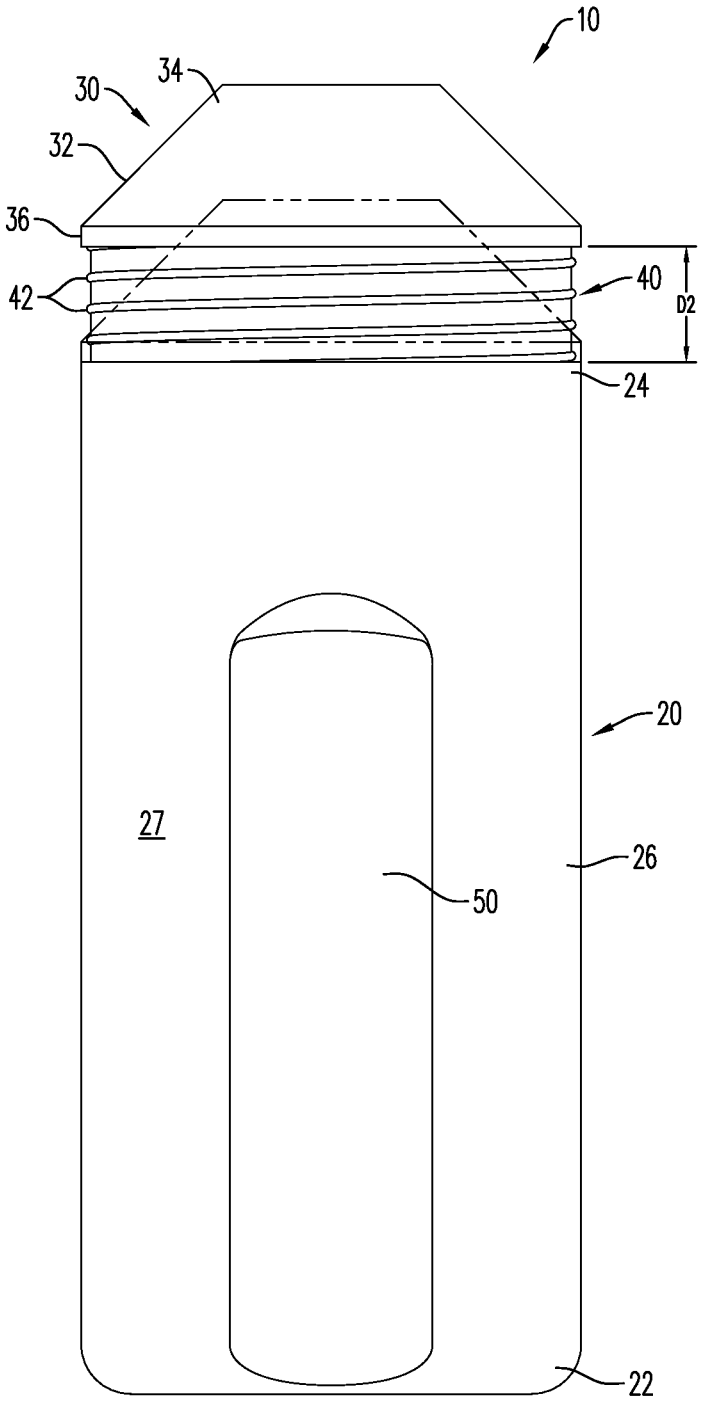
FIG. 11 is a side view of a vacuum-insulated vessel including a retaining member and a double-walled container, illustrating the adjustability of the retaining member, according to an embodiment.

Revolutions of the retaining member 30 may adjust the distance D1 between the lower portion 36 of the frustonical member 32 and the open end 24 of the double-walled structure 20. As illustrated in FIG. 11, when the external threads 42 of the cylindrical skirt 40 rotatably engage with the internal threads 28 (see, for example, FIG. 5) of the double-walled structure 20, the frustoconical body 32 can move toward and/or away from the double-walled structure 20. This also provides for the adjustment of the distance D2 between the lower portion 36 of the frustonical body 32 and the open end 24 of the double-walled structure 20. As seen for instance in FIGS. 9-11, the cylindrical skirt 40 may be entirely disposed within the chamber 25 so that there is substantially no distance between the frustoconical body 32 and the open end 24 of the structure 20. Alternatively, the cylindrical skirt 40 may be partially disposed within the chamber 25 so that there is some distance between the frustoconical body and the open end 24 of the structure 20, as shown in FIGS. 12 and 17-19. When the cylindrical skirt 40 is partially disposed within the chamber it may function as a clear view window that allows a user to easily view the contents of the double-walled structure, such as, a bottle 70 disposed therein.

Figure 12:
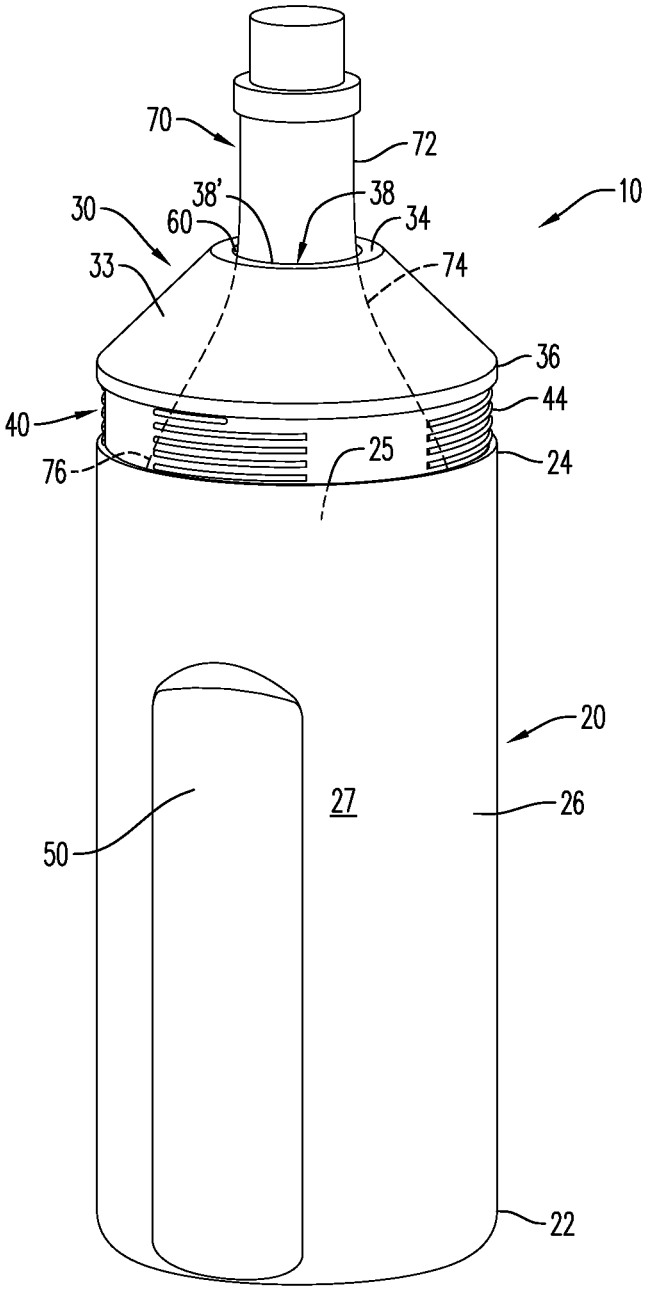
FIG. 12 is a perspective view of a vacuum-insulated vessel including a bottle, according to an embodiment.

FIG. 12 illustrates the vacuum-insulated vessel 10 having a bottle 70 positioned therein. A body/shaft 76 of the bottle may be positioned within the chamber 25 of the double-walled structure 20, and the retaining member may surround a shoulder 74 and neck 72 of the bottle 70. The opening 38 of the frustoconical body 32 may serve as a passageway for the neck 72. The deformable member 60/multilayered deformable member 160 (as seen in, for example, FIG. 18) frictionally engages with at least one of the neck 72 and a shoulder 74 of the bottle 70 so that the bottle is seated securely within the retaining member 30, while the neck 72 of the bottle 70 extends through the opening 38 of the frustoconical body 32. The deformable member 60/multilayered deformable member 160 may compress the neck 72 of the bottle 70 so that vertical and/or lateral movement of the bottle 70 is restricted, and so that the bottle's 70 contents can be poured therefrom without having to remove the bottle 70 from the vacuum insulated vessel 10.

When the bottle 70 is disposed in the chamber 25 of the double-walled structure 20, and neck 72 of the bottle 70 is secured in the retaining member 30, rotation of the retaining member 30 onto the double-walled structure 20 compresses the bottle 70 towards the closed end 22 of the double-walled structure 20. The rotation moves the frustoconical body towards and away from the double-walled structure, thereby adjusting to a height of the bottle 70 positioned in the chamber of the inner container. This, in conjunction with the deformable member 60/the multilayered deformable member 160 extending along the inner surface 31 (see for example, FIGS. 1-6) of the frustoconical body 32, restricts movement of the bottle 70, regardless of the bottle's size and/or shape. In addition, since the bottle 70 is housed within the double-walled structure 20, condensation on the surface of the bottle 70 is substantially eliminated.

According to an aspect, the vacuum-insulated vessel 10 is able to maintain the initial temperature of the contents of the bottle 70 for extended periods of time. This helps prevent the formation of condensation on the external surfaces of the bottle 70, which is often caused when the contents of a bottle are colder than the temperature of the surrounding atmosphere. As a result, since the user can pour the contents of the bottle without having to remove the bottle 70 from the vessel 10, the user does not have to hold onto potentially slippery surfaces of the bottle 70, which could lead to breakage of the bottle and loss of its contents.

According to an aspect and as shown in FIGS. 13-19, embodiments of the disclosure are further directed to a vacuum-insulated vessel 10' that includes a double-walled structure 20'. In this embodiment and as illustrated in FIG. 13, the double-walled structure 20' is substantially similar to the double-walled structure 20 illustrated in FIGS. 7-12 and described hereinabove. Thus, for purposes of convenience and not limitation, the various features, attributes, and properties, and functionality of the double-walled structure 20' discussed in connection with FIGS. 7-12 are not repeated here.

As shown in FIGS. 13-14 and 18-19, the double-walled structure 20' includes an inner container 21A, and an outer container 21B spaced apart from the inner container 21A, so that a gap 23 is formed between them. The gap 23 between the containers 21A, 21B is devoid of air by virtue of creating a vacuum between the inner and outer containers 21A, 21B. In an embodiment, each of the inner and outer containers 21A, 21B include a closed end 22', 22", an open end 24', 24", and a substantially cylindrical body 26', 26" extending between each of their closed ends 22', 22" and their open ends, 24', 24". According to an aspect, the inner container 21A and the outer container 21B are coupled and sealed at their respective open ends 24', 24", so that external air is prevented from passing through the seal and into the gap 23. This may retard the transference of heat by conduction and/or convection, so that bottles 70 (see, for example, FIGS. 18-19) positioned in an internal space/chamber 25 of the double-walled structure do not gain or lose heat. For example, a bottle 70 including a chilled beverage will not gain heat to cause the beverage to become warm or hot. Rather, the containers 21A, 21B will limit the transference of heat from external sources, such as a warm environment, to the chilled beverage.

Figure 15:
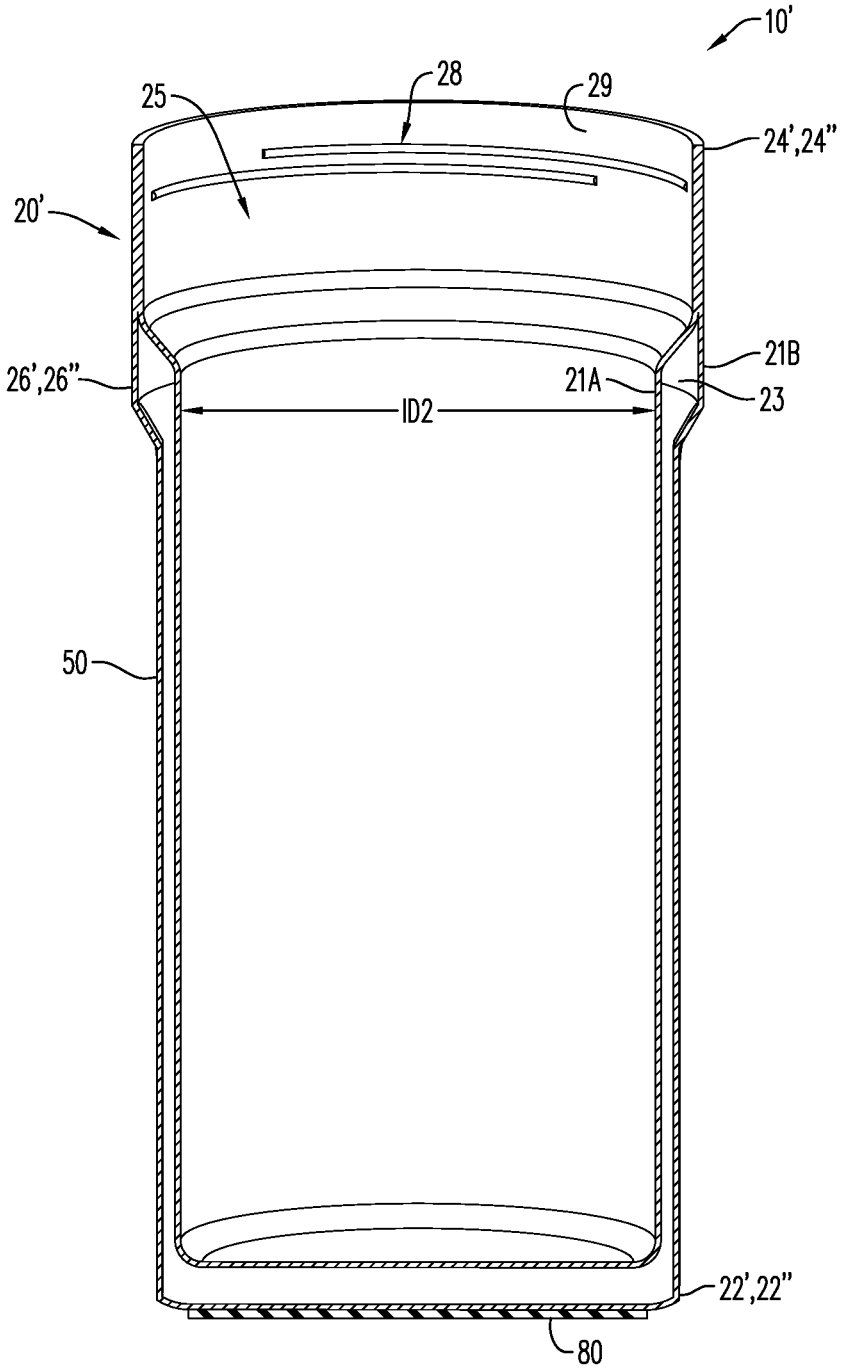
FIG. 15 is a cross-sectional view of the double-walled container of FIG. 9, illustrating an inner container having a continuous thread pattern, according to an embodiment.

The inner container 21A includes a plurality of internal threads 28 formed on its internal surface 29 at its open end 24'. The internal threads 28 may be a continuous/spiral thread pattern (FIGS. 13-14) or an interrupted/non-continuous thread pattern (FIG. 15). The internal threads 28 may be configured for engagement with corresponding threads of a retaining member 30, as seen for example, in FIGS. 18-19. The retaining member 30 may include a deformable member 60 or a multilayered deformable member 160 (see, for example, FIGS. 17-18). In this embodiment, the retaining member 30, the deformable member 60, and the multilayered deformable member 160 are similar to the retaining member 30, the deformable member 60, and the multilayered deformable member 160 illustrated in FIGS. 1-6, and described hereinabove. Thus, for purposes of convenience and not limitation, the various features, attributes, and properties, and functionality of the retaining member 30, the deformable member 60 and the multilayered deformable member 160 discussed in connection with FIGS. 1-6 are not repeated here.

Figure 16:
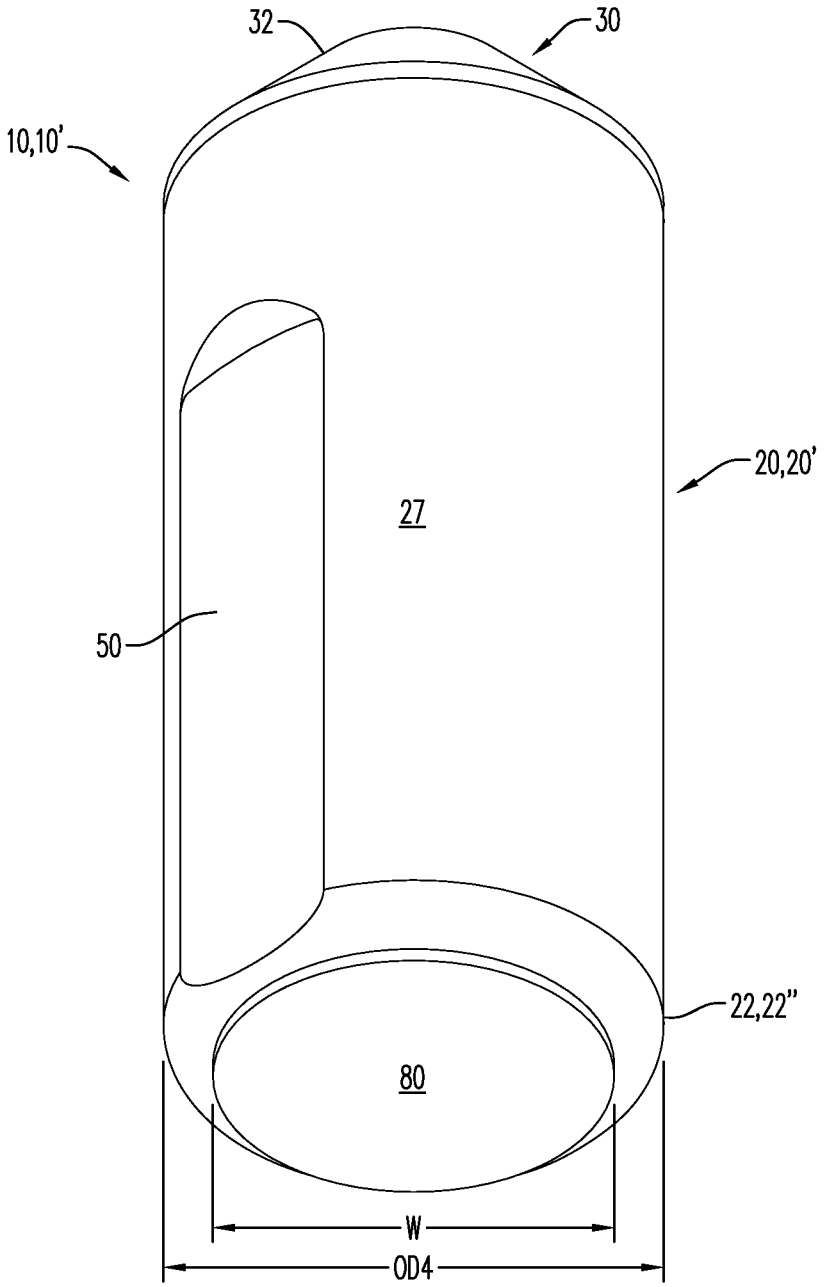
FIG. 16 is a bottom up, perspective view of a vacuum-insulated vessel, according to an embodiment.

As described hereinabove with reference to FIGS. 8-12, the retaining member 30 is positioned adjacent the open end 22' of the inner container 21A. According to an aspect and as illustrated in FIG. 16, the frustoconical body 32 of the retaining member 30 may be flush with an external surface 27' of the double-walled structure 20' adjacent its open ends 22', 22". In this embodiment, the outer container 21B includes an outer diameter $OD_4$ that is substantially the same as the outer diameter $OD_3$ of the lower portion 36 of the frustoconical body 32, and the inner container 21A includes an inner diameter $ID_2$ that facilitates engagement of its internal threads 28 with the external threads 44 of the cylindrical skirt 40.

Figure 17:
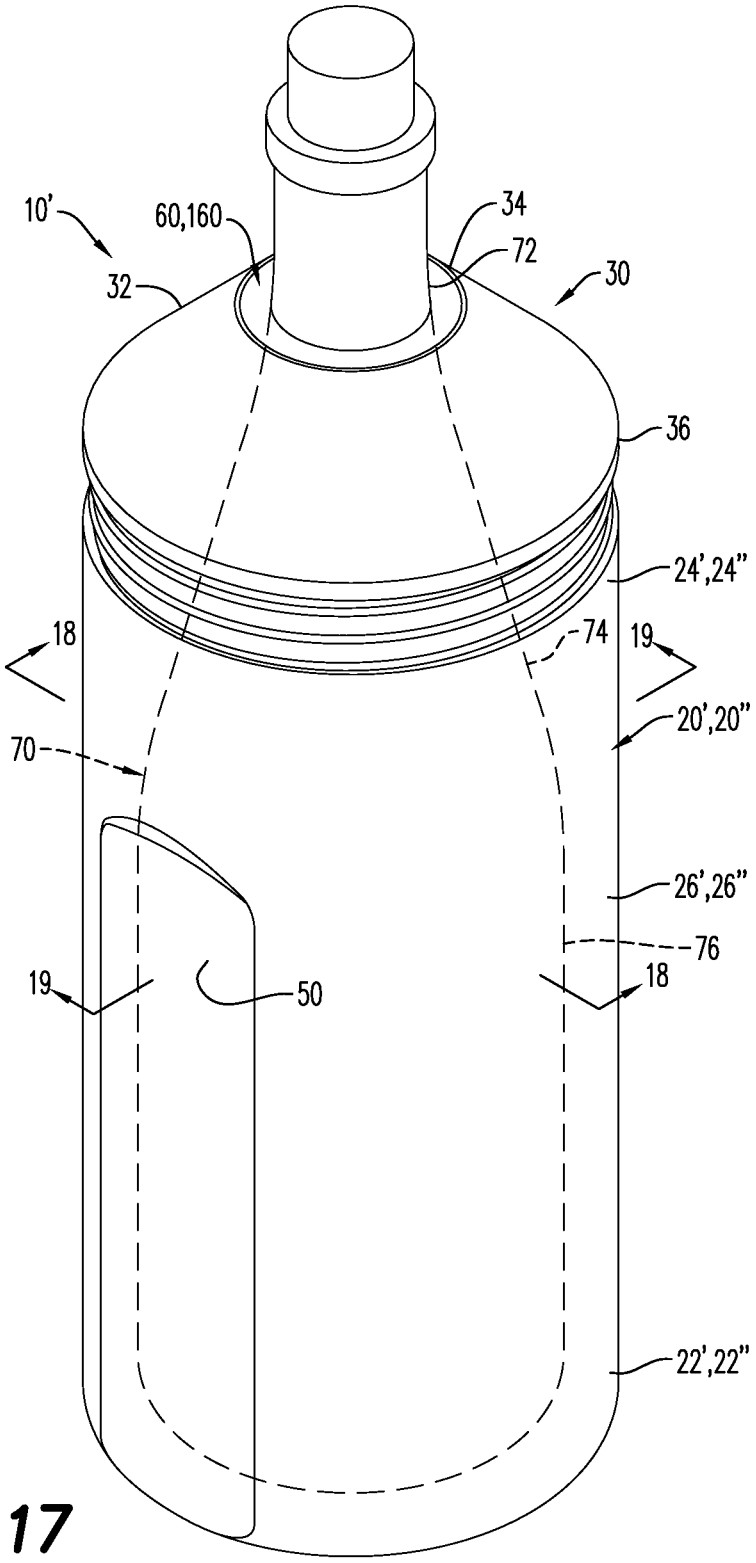
FIG. 17 is a top down, perspective view of the vacuum-insulated vessel of FIG. 16, illustrating a bottle secured therein, according to an embodiment.
Figure 18:
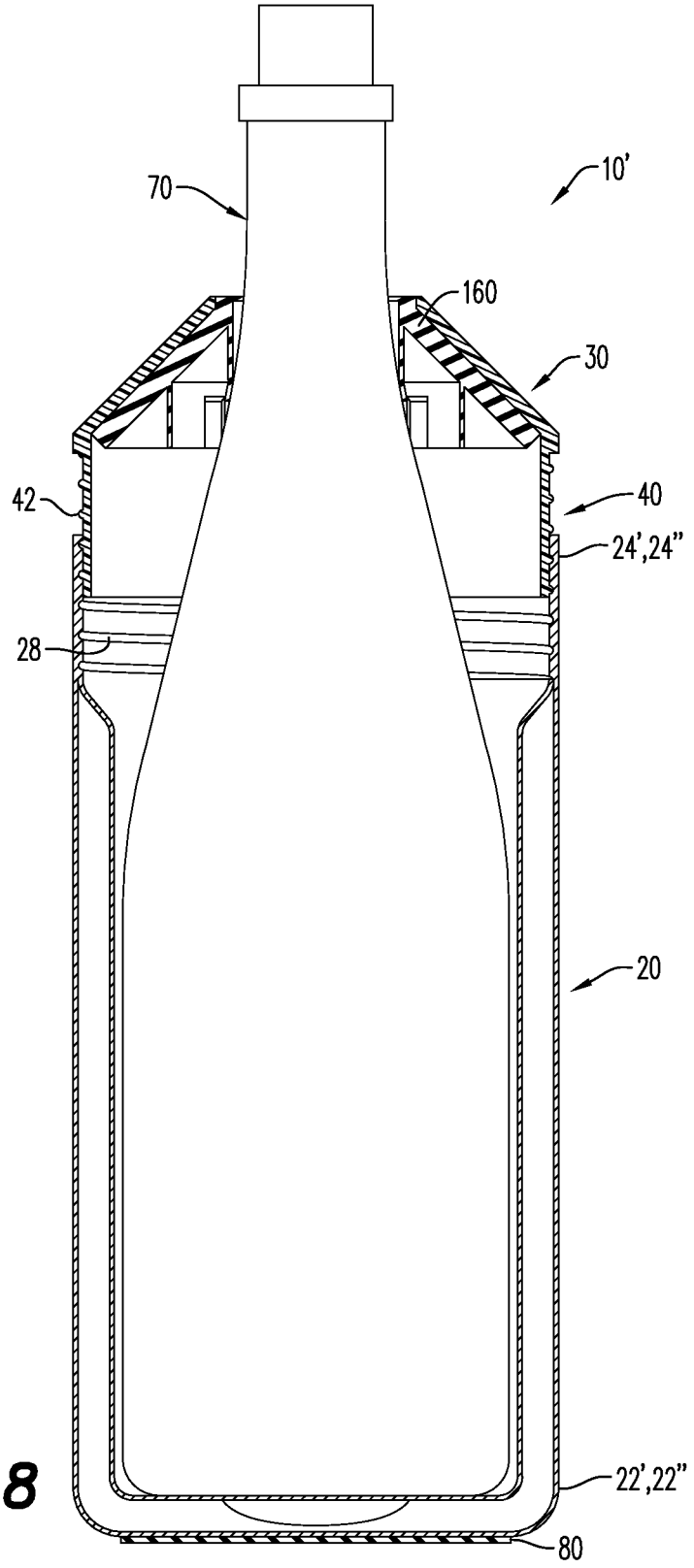
FIG. 18 is a cross-sectional view of the vacuum-insulated vessel of FIG. 17.
Figure 19:
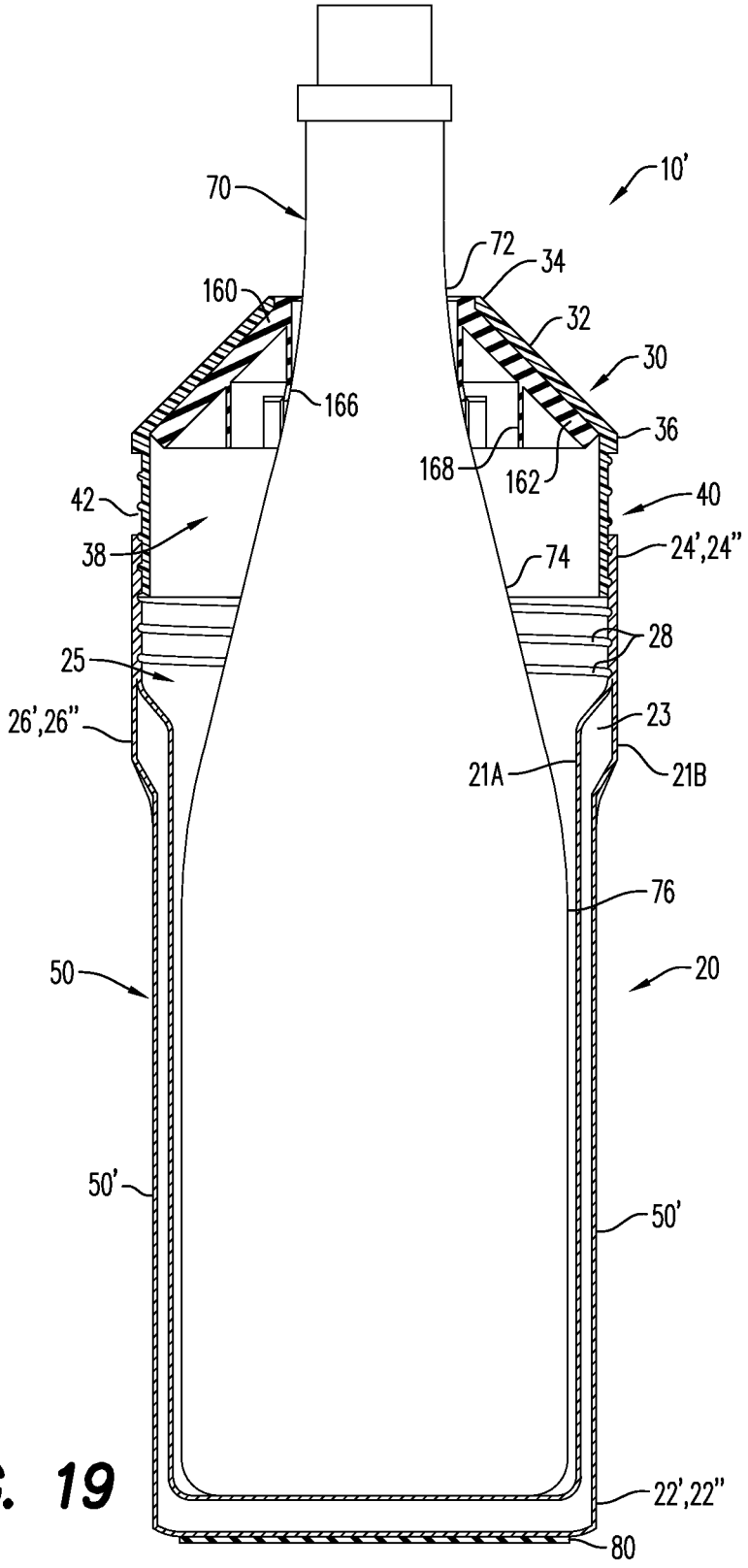
FIG. 19 is a cross-sectional view of the vacuum-insulated vessel of FIG. 17, illustrating bilateral indentations, according to an aspect.

FIGS. 17-19 illustrate a bottle 70 disposed within a chamber 25 of the vacuum-insulated vessel 10'. The body 76 of the bottle 70 is adjacent the inner container 21A, and the retaining member 30 surrounds a shoulder 74 and neck 72 of the bottle 70 with the opening 38 of the frustoconical body 32 serving as a passageway for the neck 72. As the retaining member is rotated onto the double-walled container 20', the external threads of the cylindrical skirt 40 engage with the internal threads 28 of the inner container 21A. The rotation may also compress the bottle towards the closed end 22', 22" of the double-walled structure.

FIGS. 18-19 illustrate the retaining member 30 having a multilayered deformable member 160. The rotation may compress the neck 72 of the bottle 70 against the circumferential edge portion 161 of the multilayered deformable member 160. According to an aspect, the first or second concentric layers 166, 168 may compress the neck 72 or shoulder 74 of the bottle 70, either in lieu of or in addition to the circumferential edge portion 161. FIG. 18 illustrates the first concentric layer 166 compressing the neck of the bottle 70, however, it is contemplated that the second concentric layer 168 and/or the first layer 162 may also provide compression to the bottle 70. For instance, while the first concentric layer 166 will the be closest to the bottle 70, thereby serving as one of the first retention or compression means, the second concentric layer 168 or the first layer 162 may also provide added compression for the neck 72 or shoulder 74 of wider or taller bottles 70, thereby further restricting movement of the bottle 70.

The insulating vessel 10, 10' described hereinabove may be able to protect the surfaces on which they are placed from scratches, water stains, and other surface damage. As illustrated in, for example, FIGS. 8 and 18-19, a coaster 80 may be adjacent the closed ends 22, 22" (or base) of the double-walled structures 20, 20'. The coaster 80 may have a width W that is less than the outer diameter $OD_4$ of the double-walled structure 20, 20', so that at least a portion of the external surface 27 of the structure 20, 20' at the closed end 22, 22' remains uncovered. The coaster 80 may include and/or be formed from materials that reduce friction between the double-walled structure 20, 20' and smooth/slippery surfaces, such as glass, granite, wood, and the like. According to an aspect, the coaster is formed from a variety of materials, including rubber, plastic, and foam, as would be understood by one of ordinary skill in the art. The coaster 80 may help stabilize the vessel 10, 10' when positioned on slippery surfaces, helping to prevent potential spill of contents of a bottle 70 within the vessel 10, 10' and, in some instances, damage of the surface.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the vacuum-insulated vessel, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A retaining member, comprising:

a body comprising an upper portion, a lower portion, and a frustoconical portion extending between the upper and lower portions;

a cylindrical skirt extending from the lower portion of the body; and a deformable member extending from the upper portion, wherein the retaining member forms an opening in the upper portion of the body to receive a neck of a bottle therethrough, the deformable member overlaps the opening, at an upper edge of the upper portion, and has an inner diameter that is less than an inner diameter of the upper portion, and the cylindrical skirt of the retaining member is configured to engage an internal surface of a vacuum-insulated vessel to retain the bottle within the vacuum-insulated vessel, such that a user can access contents of the bottle without removing the bottle from the vacuum-insulated vessel.

2. The retaining member of claim 1, wherein the cylindrical skirt comprises a plurality of external threads formed on its external surface.

3. The retaining member of claim 1, wherein the deformable member further comprises a circumferential edge portion.

4. The retaining member of claim 1, wherein the body and the cylindrical skirt comprises a polymeric material.

5. The retaining member of claim 1, wherein the deformable member comprises at least one concentric layer concentric with the frustoconical portion, the concentric layer comprising a resilient free end having a peripheral edge, the resilient free end having a plurality of longitudinally opening notches formed in the peripheral edge.

6. The retaining member of claim 1, wherein the deformable member is formed from an opaque material.

7. The retaining member of claim 1, wherein the cylindrical skirt comprises a thread that facilitates frictional retention of the cylindrical skirt in the vacuum-insulated vessel.

8. The retaining member of claim 7, wherein the thread is a continuous thread or a plurality of non-continuous threads.

9. A retaining member, comprising:

a body comprising an upper portion, a lower portion, and a frustoconical portion extending between the upper and lower portions, wherein an opening is formed in the upper portion of the body to receive a neck of a bottle therethrough;

a deformable member extending from the upper portion and overlapping the opening, at an upper edge of the upper portion, the deformable member having an inner diameter that is less than an inner diameter of the upper portion; and a cylindrical skirt extending from the lower portion of the body, wherein the cylindrical skirt includes an outer diameter that is less than an outer diameter of the lower portion of the body, and the cylindrical skirt is receivable within an interior space of a vacuum-insulated vessel and is configured to engage an internal surface of the vacuum-insulated vessel to retain the bottle within the vacuum-insulated vessel, such that a user can access contents of the bottle without removing the bottle from the vacuum-insulated vessel.

10. The retaining member of claim 9, wherein the cylindrical skirt comprises a plurality of external threads formed on its external surface.

11. The retaining member of claim 9, wherein the deformable member further comprises a circumferential edge portion.

12. The retaining member of claim 9, wherein the body and the cylindrical skirt comprises a polymeric material.

13. The retaining member of claim 9, wherein the deformable member comprises at least one concentric layer concentric with the frustoconical portion, the concentric layer comprising a resilient free end having a peripheral edge, the resilient free end having a plurality of longitudinally opening notches formed in the peripheral edge.

14. The retaining member of claim 9, wherein the deformable member is formed from an opaque material.

15. The retaining member of claim 9, wherein the cylindrical skirt comprises a thread that facilitates frictional retention of the cylindrical skirt in the vacuum-insulated vessel.

16. The retaining member of claim 15, wherein the thread is a continuous thread or a plurality of non-continuous threads.

17. A retaining member, comprising:

a body comprising an upper portion, a lower portion, and a frustoconical portion extending between the upper and lower portions;

a cylindrical skirt extending from the lower portion of the body; and a deformable member extending from the upper portion and comprising a cylindrical portion, wherein the retaining member forms an opening that extends from the upper portion to the cylindrical skirt, the cylindrical portion of the deformable member communicates with the opening at the upper portion of the body to frictionally retain the neck of the bottle, and the cylindrical skirt is configured to engage an internal surface of a vacuum-insulated vessel to retain the bottle within the vacuum-insulated vessel, such that a user can access contents of the bottle without removing the bottle from the vacuum-insulated vessel.

18. The retaining member of claim 17, wherein the cylindrical skirt comprises a plurality of external threads formed on its external surface.

19. The retaining member of claim 17, wherein cylindrical portion of the deformable member comprises a plurality of longitudinally opening notches.

20. The retaining member of claim 17, wherein the deformable member is formed from an opaque material.

* * * * *